US006443039B1

(12) United States Patent
Warner

(10) Patent No.: US 6,443,039 B1
(45) Date of Patent: Sep. 3, 2002

(54) WRENCHES HAVING TWO DRIVING STEMS PIVOTALLY CONNECTED WITH EACH OTHER

(75) Inventor: Mark S. Warner, Mission Viejo, CA (US)

(73) Assignees: Mark Warner, Mission Viejo, CA (US); Paul Petersen, Mission Viejo, CA (US)

( * ) Notice: Subject to any disclaimer, the term of this patent is extended or adjusted under 35 U.S.C. 154(b) by 0 days.

(21) Appl. No.: 09/649,745

(22) Filed: Aug. 28, 2000

Related U.S. Application Data

(63) Continuation-in-part of application No. 09/542,824, filed on Apr. 4, 2000, now Pat. No. 6,314,844.

(51) Int. Cl.[7] ..... B25B 23/00
(52) U.S. Cl. ..... 81/440; 81/177.6
(58) Field of Search ..... 81/440, 177.2, 81/177.6, 177.7, 458, 488; 7/165, 100

(56) References Cited

U.S. PATENT DOCUMENTS 1,302,197 A * 4/1919 Miller et al. ..... 81/125.1
2,679,778 A * 6/1954 Krafft ..... 81/439
2,951,405 A * 9/1960 Engquist ..... 81/440
4,271,731 A * 6/1981 Suligoy et al. ..... 81/440
6,016,728 A * 1/2000 Bohl ..... 81/437

FOREIGN PATENT DOCUMENTS

GB 2 050 899 A * 1/1981 ..... 81/450

* cited by examiner

*Primary Examiner*—Joseph J. Hail, III
*Assistant Examiner*—David B. Thomas
(74) *Attorney, Agent, or Firm*—Wu & Cheung, LLP; Charles C. H. Wu

(57) ABSTRACT

A wrench having two driving stems pivotally connected with each other. One of the driving stems has a main stem and a female joint protruding from a rectangular or cylindrical section of the main stem with a hole at a center thereof. The other driving stem has the other main stem and a male joint projecting out of the center of a rectangular or cylindrical section of the main stem. The male joint and the female joint are engaged with each other via a coupler such as a roll pin. Therefore, without using an additional hinge or other mechanical coupler, these two driving stems are pivotally connected with each other.

6 Claims, 9 Drawing Sheets

14
12
10
26

14
10
26

WRENCHES HAVING TWO DRIVING STEMS PIVOTALLY CONNECTED WITH EACH OTHER

CROSS REFERENCE

This application is a continuation in part of the parent application Ser. No. 09/542,824 filed Apr. 4, 2000, now U.S. Pat. No. 6,314,844 the full disclosure of which is incorporated herein by reference.

BACKGROUND OF THE INVENTION

1. Field of the Invention

The invention relates in general to a wrench having two driving stems pivotally connected with each other. More particularly, this invention relates to a hex key type or Allen wrench having two individual driving stems pivotally connected with each other.

2. Description of the Related Art

A conventional wrench, for example, an Allen wrench, used for gripping and turning or twisting the head of a bolt, a cap screw, a nut, a pipe, or the like commonly comprises a one-piece L-shape metal with one end used as the driving stem and the other end used as a handle.

In U.S. Pat. No. 5,943,925, Huang discloses a tool having a foldable structure. The foldable structure disclosed by Huang comprises a coupler pivotally coupled between a driving stem and a handle. Applying the foldable structure to the Allen wrench, the driving stem can be folded in parallel with the handle, that is, with a zero angle relative to the handle. This results in a more compact space for storing the tool. In Huang, with respect to the handle, the driving stem can be rotated from an angle of zero degrees to an angle of 180 degrees. While turning a bolt in a limited space, for example, around the boundary of two perpendicularly joint planes, the handle of the Allen wrench adopting the foldable structure disclosed by Huang can only be turned between zero degrees to 180 degrees along a surface perpendicular to the driving stem. When a half circle of the turning action is complete, the user has to disengage the wrench from the bolt. By repositioning the handle to the original point of the turning action, the turning action is repeated until the bolt is fastened as required.

In other words, while tightening/untightening a screw, a bolt or a nut in a plane with a limited degree of freedom, a user may need to repeat engaging and disengaging the driving stem to reposition the handle. Moreover, using this conventional structure, there is only one end of the wrench that can be used as the driving tool while the other end is used as a handle only. When a different torque is required, or a screw, a bolt or a nut with different depth is to be driven thereby, a different driving stem has to be connected and reassembled.

SUMMARY OF THE INVENTION

The invention provides a wrench having two driving stems pivotally connected with each other. One of the driving stems has a female fork joint protruding from the main stem with a hole at the center thereof. The other driving stem has a male connecting joint protruding form the axial center of the main stem. The male joint and the female joint are engaged with each other via a connector such as a roll pin. Therefore, without using an additional hinge or other mechanical coupler, these two driving stems are pivotally connected with each other. One of these two pivotally connected driving stems flips from an angle of about 90 degrees to an angle of about 270 degrees relative to the other.

Thus arranged, one of the driving stems used as a handle can flip with an angle from about 90 degrees to about 270 degrees with respect to the other of the driving stems used for driving a screw, a bolt or a nut. Therefore, when the rotation of the handle is obstructed, the handle can be lifted up or down to perform fastening or removing. The specific flipping angle of the handle actually depends on the distance between the driving stems. That is, the handle can also be flipped from an angle less than 90 degrees to an angle larger than 270 degrees.

The applicability of the wrench structure provided by the invention is also applicable for driving a socket head screw, bolt or nut in a space with limited degree of freedom, for example, in the situation that the rotation of the handle is obstructed by the presence of an object. For example, while driving a socket head cap screw on a plane with a second plane protruding nearby, the screw is engaged with the driving stem, and the handle is turned to drive the driving stem, so as to thread/unthread the screw. Being obstructed by the protruding object, the rotating range of the handle is limited within a certain angle along a surface parallel to the first plane. When the rotating action of the handle is from one end to the other, that is, from an angle of zero degree to the certain degree along the surface, the user does not need to disengage the driving stem from the nut. Instead, the user can simply flip the handle to the other end, that is, from the angle of 90 degrees to 270 degrees relative to the driving stem, and carry on driving the screw.

In addition, with the structure of two driving stems pivotally connected together, one may choose either one of the driving stems as a handle, and the other driving stem to engage and drive an object, for example, a screw, a nut, a bolt or the like. When an object with a different depth is to be engaged and driven, or when a different torque is required, one may interchange the functions of these two driving stems. Further, in certain circumstances, the user may choose to align the two stems with each other (at zero degree angle) and drive the object by applying a socket wrench to the free end of the stem opposite the driving stem.

Both the foregoing general description and the following detailed description are exemplary and explanatory only and are not restrictive of the invention, as claimed.

DESCRIPTION OF THE PREFERRED EMBODIMENTS

Figures 1, 1A, 1B:
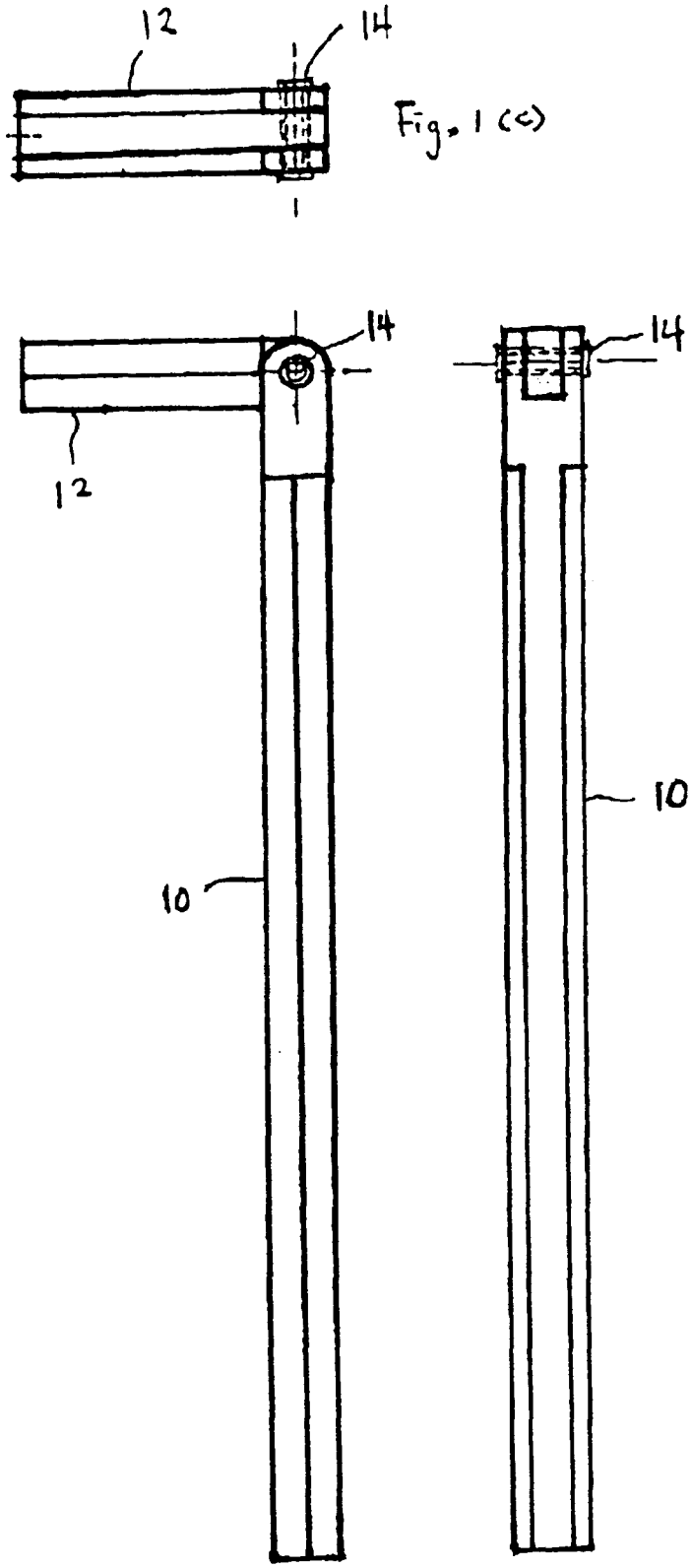
FIG. 1(*a*) to FIG. 1(*g*) are side and front views of a wrench with one driving stem positioned perpendicularly to the other driving stem in accordance with the present invention.
Figures 1D, 1E:
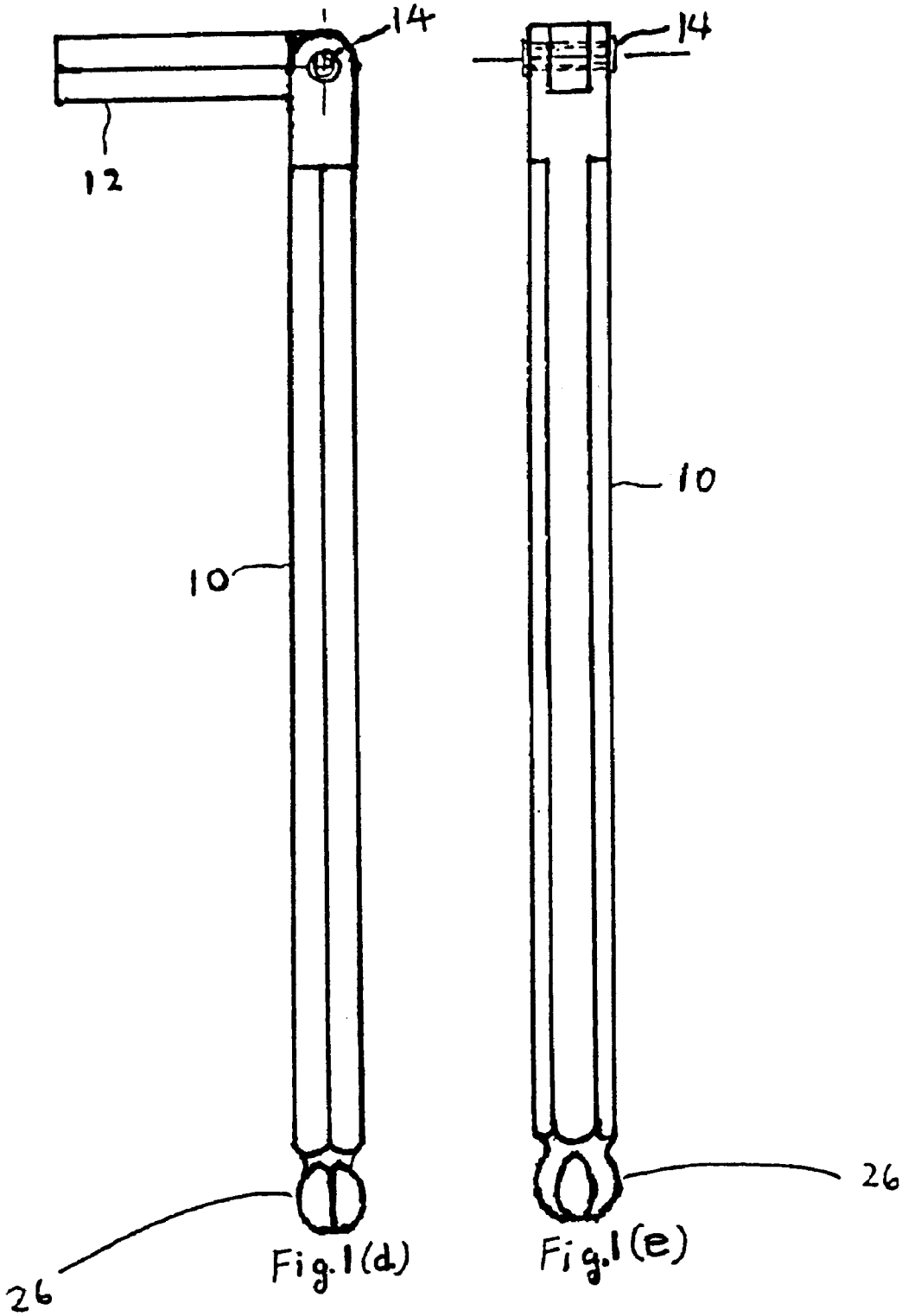
Figure 1F:
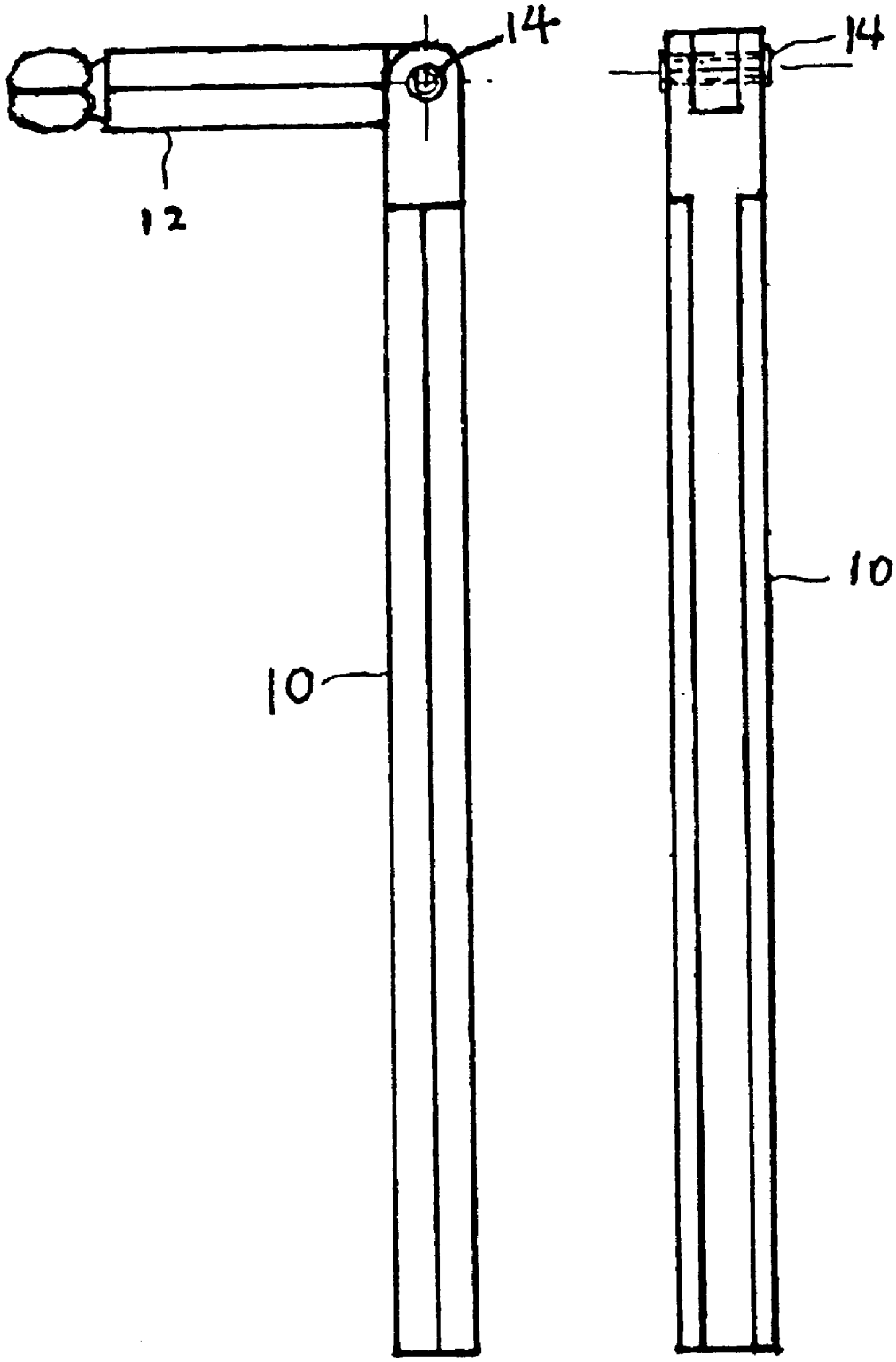
Figure 1G:
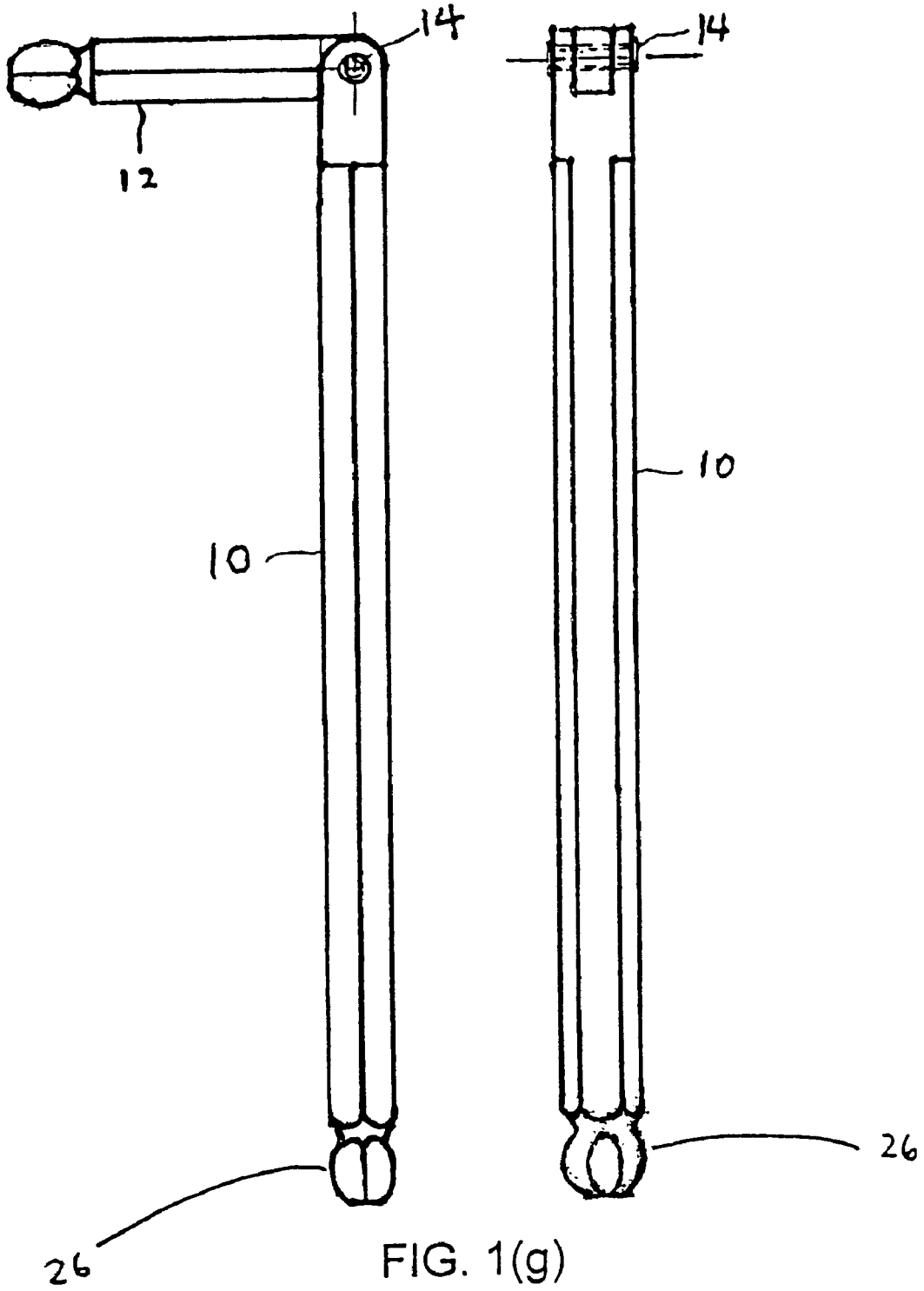
Figure 2D:
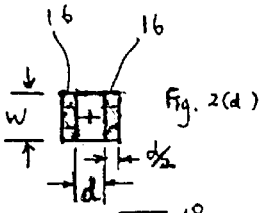
FIG. 2(*a*) to FIG. 2(*d*) show different views of one of the driving stems with a female joint in accordance with the present invention.
Figure 2A:
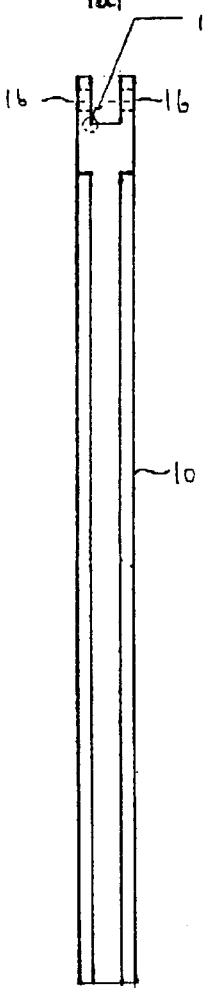
Figure 2B:
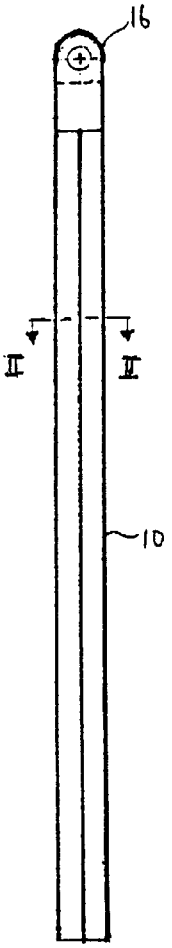
Figure 2C:
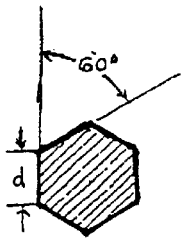
Figure 3D:
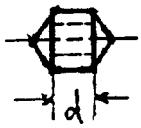
FIG. 3(*a*) to FIG. 3(*d*) show different views of one of the driving stems with a male joint in accordance with the present invention.
Figure 3A:
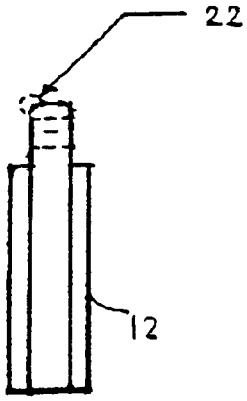
Figure 3B:
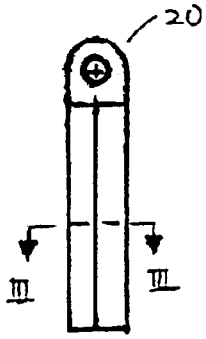
Figure 3C:
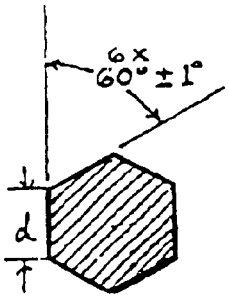

FIGS. 1(*a*) to 6(*e*) illustrate the present invention embodied by a hex-key type or Allen wrench with two driving stems pivotally connected with each other. Being pivotally connected, one of the driving stems is used as a handle to drive the other driving stem so that an object such as a socket head nut, screw or bolt can be threaded or unthreaded. When one is threading/unthreading the object, the handle can be flipped from an angle of about 90 degrees to about 270 degrees with respect to the driving stem used to unthread/unthread the object. In this manner, even with the presence of an object that obstructs the threading/unthreading operation, the user does not need to disengage the object and rotate the handle to carry on threading/unthreading. Instead, one can simply flip over the handle and repeat rotating the handle to complete the threading/unthreading operation. In addition to the application of a hex-key or Allen wrench, it is appreciated that people of skill in the art may modify the disclosure of this embodiment and apply to other types of driving tools such as a box wrench, an open-end wrench, a socket wrench, or the like.

FIG. 1(*a*) shows a side view of the wrench comprising two driving stems pivotally connected with each other. In this embodiment, a roll pin 14 is used to thread through each of the driving stems. It is appreciated that the roll pin 14 can also replaced with other similar coupler such as a set of bolt and nut. The usage of the roll pin 14 can be clearly observed from the partly exploded front views as shown in FIG. 1(*a*) and FIG. 1(*b*). FIGS. 1(*a*) to 1(*c*) all show the wrench with the driving stems 10, 12 positioned perpendicularly with each other.

As an alternative configuration, FIGS. 1(*d*) and 1(*e*) show the wrench having an end with cut away grove and rounded stem end corners 26 at one end of the driving stem 10. Said rounded end is designed for ease of engaging the wrench with the fastening device such as a screw, a bolt, or a nut. As an alternative configuration, FIG. 1(*f*) shows the cut away grove and rounded stem end corners 26 at one end of the driving stem 12. As another alternative configuration, FIG. 1(*g*) shows the cut away grove and rounded stem end corners 26 being at one end of the driving stem 10 and at one end of the driving stem 12.

FIGS. 2(*a*) and 2(*b*) show both the side view and the front view of the driving stem 10 of the wrench. As shown in FIG. 2(*a*), the driving stem 10 comprises a female joint at one end thereof. At the end of the driving stem 10, a rectangular section extends from the driving stem, and two fillets 16 with equal dimensions stand out from two opposite edges of the rectangular section and leave a space in between. FIG. 2(*c*) shows a cross sectional view of the driving stem 10 cutting along the line II—II. As shown in FIG. 2(*c*), the cross section of the driving stem 10 is a hexagon with a width of d for each side. The cant of each side is about 60 degrees.

As illustrated in FIG. 2(*d*), the width of the fillets 16 is equal to $\sqrt{3}$d, and the thickness of each plate is equal to half of the length of each side, that is, d/2. It is appreciated that the thickness and width are not limited only to such magnitudes and the wrench can still work properly while the thickness of the fillets vary. Referring to FIG. 2(*b*), each of the fillets 16 has a hole in the center thereof. The holes of both fillets 16 align with each other such that a roll pin 14 as shown in FIG. 1(*a*) can thread through both holes.

FIGS. 3(*a*) to 3(*c*) show the driving stem 12 with a male joint 22. The male joint 22 includes a projection of rectangular cross section which protrudes from a central portion of one end from one side to the opposite side of the driving stem 12. The male joint 22 has a thickness to be fitted into the space between two fillets 16 of the female joint of the driving stem 10. Preferably, the thickness is approximately equal to the length d of one side of the driving stem 10. The width of the projection 22 is about $\sqrt{3}$d.

FIG. 3(*c*) shows a cross sectional view of the driving stem 12 along the cutting line III—III. It is clearly seen that the driving stem 12 has a hexagon cross section with each side having a width of d. A top view of the male joint on top of the driving stem 12 is shown as FIG. 3(*d*). The male joint also has a hole in the center thereof to enable the roll pin 14 to thread through as shown in FIG. 3(*b*). Referring to FIG. 3(*b*), the male joint is a dome like structure having a width approximately the same as the width of the space between the fillets 16 in the driving stem 10. Thus, these two stems 10 and 12 are pivotally coupled to each. One can thus flip one of the driving stems 10 and 12 from an angle of 90 degrees to an angle of 270 degrees with respect to the other driving stem.

Figure 4:
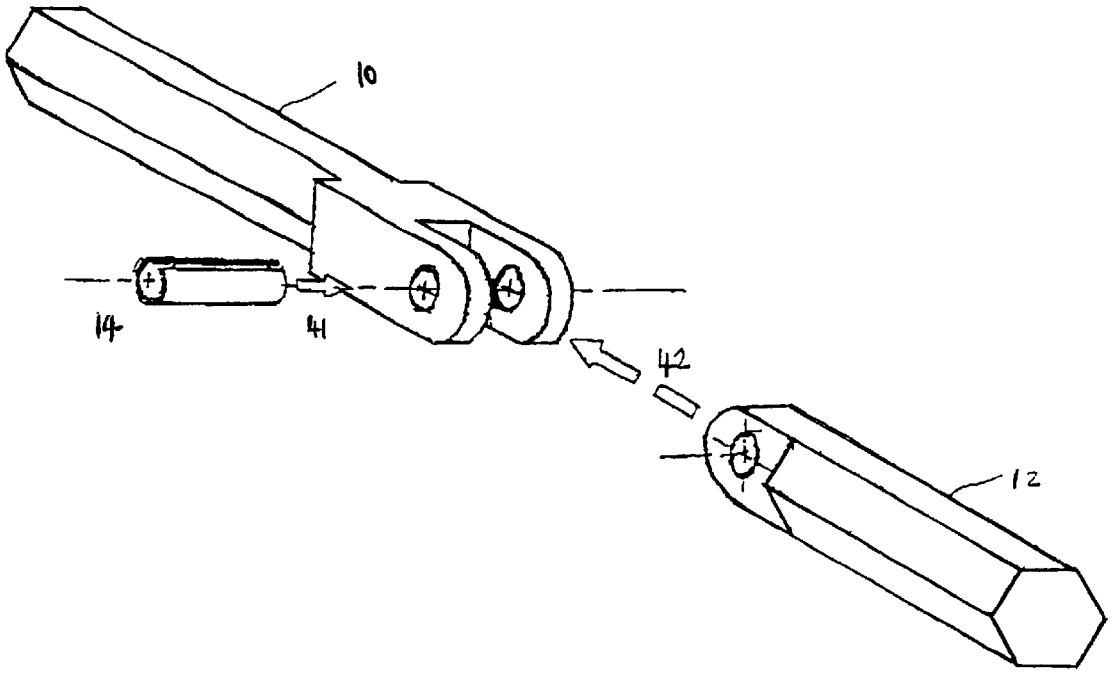
FIG. 4 shows the method of assembling two driving stems in accordance with present invention.
Figure 5D:
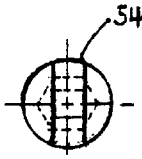
FIG. 5(*a*) to FIG. 5(*d*) are different views of a driving stem with a male joint in another embodiment according to the invention (i.e. an alternative design with greater strength male joint)
Figure 5A:
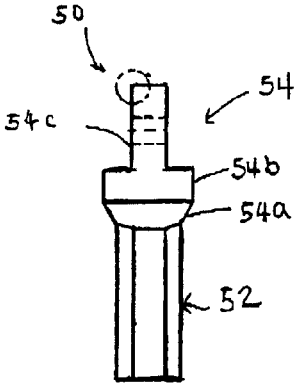
Figure 5B:
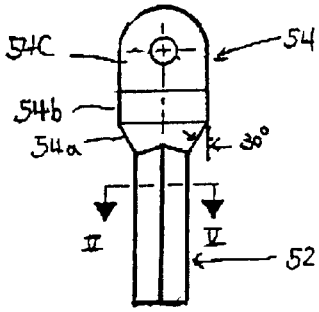
Figure 5C:
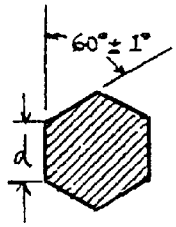
Figure 6D:
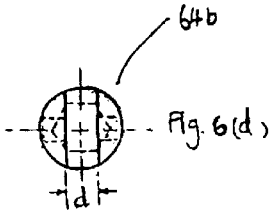
FIG. 6(*a*) to FIG. 6(*d*) are different views of a driving stem with a female joint in another embodiment according to the invention (i.e., an alternative design with greater strength female joint.)
Figure 6A:
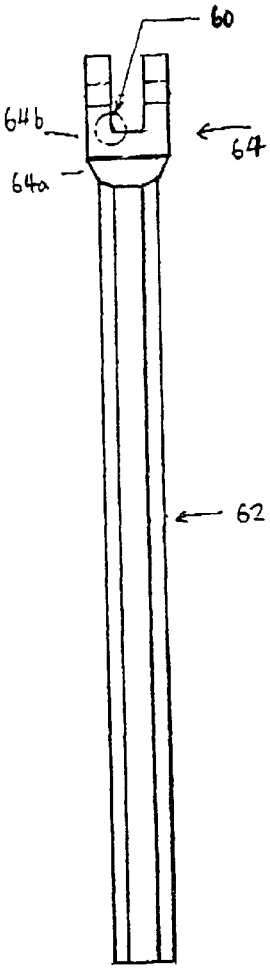
Figure 6B:
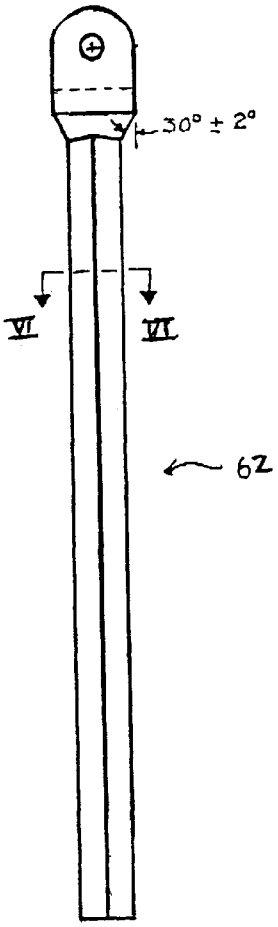
Figure 6C:
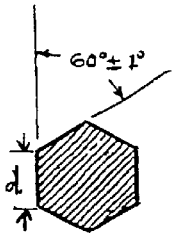

FIG. 4 shows the assembly of the driving stems 10 and 12. The length of both driving stems 10 and 12 can be varied according to specific requirement. Preferably, the driving stem 10 with a female joint is longer than the driving stem with a male joint. While assembling as shown in FIG. 4, for example, the driving stem 12 is approaching the driving stem 10 with the male joint towards the female joint along the direction of arrow 42. Being engaged with the driving stem 10, a roll pin 14 threads into the holes of the male and female joint to fasten the driving stems 10 and 12 to an extent that one of them can flip over the other. Radial compression of the roll pin while being inserted provides some rotational resistance to the rotating action. The direction to thread the roll pin 14 through both the driving stems 10 and 12 is illustrated as the arrow 41.

FIG. 5(*a*) to FIG. 6(*e*) show another embodiment according to the invention. In FIG. 5(*a*) to FIG. 5(*e*), a driving stem with another type of male joint is illustrated, while in FIG. 6(*a*) to FIG. 6(*e*), a driving stem with another type of female joint is illustrated. In this embodiment, preferably, the driving stem with a male joint is shorter than the driving stem with a female joint.

FIG. 5(*a*) and FIG. 5(*b*) are a side view and front view of the driving stem with a male joint. In FIG. 5(*a*), one end of the driving stem 52 comprises a male joint portion 54. The male joint portion further comprises a base portion 54*a* extending from the main stem of the driving stem 52 with a curved bottom and a flat top. On top of the flat top of the base portion 54*a*, there is a flat plate 54*b*, and at the central portion of the flat plate 54*b*, a fillet 54*c* stands out. The side view of such male joint portion 54 is shown in FIG. 5(*b*).

A cross sectional view cutting along the line V—V is shown as FIG. 5(*c*). The cross section of the main stem of the driving stem 52 is in a hexagonal shape with each side having a width of d and a cant of about 60 degrees.

A top view of the male joint portion 54 is shown as FIG. 5(*d*). From the top view, the male joint portion 54 is like a circle that covers the whole cross section of the main stem. The thickness of the fillet 54*c* is approximately equal to d, and the width of the fillet 54*c*, that is, the diameter of the male joint base portion 54*b* is substantially larger than $\sqrt{3}$d.

In addition, as shown in FIG. 5(*e*), the edge 50 of the fillet 54*c* has been rounded. FIG. 6(*a*) and FIG. 6(*b*) are a side view and front view of the driving stem 62 with a female joint 64. In FIG. 6(*a*), one end of the driving stem 62 comprises a female joint portion 64. The female joint portion further comprises a base portion 64*a* extending from the main stem of the driving stem 62 with a curve bottom and a flat top. Protruding from the cylindrical base portion 64, there is a fork-like structure 64*b* that allows the fillet 54*c* of the driving stem 52 in FIG. 5(*a*) to be engaged therein. The fork-like structure, as shown in FIG. 6(*a*), comprises a slotted extension of the cylindrical base portion 64 with a rounded end as shown by FIG. 6(*b*), thereby forming two prongs with flat machined interior faces and cylindrical curved outer surfaces as shown by FIGS. 6(*a*) and 6(*d*).

The side view of such female joint portion 64 is shown in FIG. 6(*b*). A cross sectional view cutting along the line VI—VI is shown as FIG. 6(*c*). The cross section of the main stem of the driving stem 62 is a hexagonal shape with each side having a width of d and a cant of about 60 degrees. A top view of the female joint portion 64 is shown as FIG. 6(*d*). From the top view, space allowing the fillet 54*c* to be engaged therein has a thickness of approximately d, and the base section diameter of the female joint portion 64 is much larger than $\sqrt{3}$d with exact dimension based on strength calculations.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A wrench, comprising:

a first driving stem, comprising further:

a main stem; and female joint, further comprising two fillets protruding from two opposite sides of the main stem with a space in between, wherein each fillet comprises a hole;

a second driving stem, comprising further:

a main stem; and a male joint, comprising a hole and protruding from the main body at a center thereof;

an engaging means, being threaded through the holes of the fillets of the first driving stem and the hole of the male joint projection of the second driving stems while the male projection is engaged within the space between the fillets.

2. The wrench according to claim 1, wherein the first and the second driving stems comprise hex-keys.

3. The wrench according to claim 1, wherein the first and the second driving stems each have a rounded end to flip over the other driving stem.

4. The wrench according to claim 1, wherein the first and the second driving stems are of different lengths.

5. The wrench according to claim 1, wherein said driving stem having an end portion opposite of the female joint, said end portion having rounded corners and a grove between said rounded corners and the driving stem.

6. The wrench according to claim 1, wherein said first driving stem having an end portion opposite of the female joint, said end portion having a cut-away grove and a rounded end at the end of said stem.

* * * * *